US011634254B2

(12) United States Patent
Tidwell et al.

(10) Patent No.: US 11,634,254 B2
(45) Date of Patent: Apr. 25, 2023

(54) CHILD-RESISTANT LID AND RELATED METHODS

(71) Applicant: PWS Packaging Services, Inc., La Jolla, CA (US)

(72) Inventors: Justin Tidwell, Brea, CA (US); William Tidwell, Brea, CA (US)

( * ) Notice: Subject to any disclaimer, the term of this patent is extended or adjusted under 35 U.S.C. 154(b) by 0 days.

(21) Appl. No.: 17/064,008

(22) Filed: Oct. 6, 2020

(65) Prior Publication Data

US 2022/0106082 A1 Apr. 7, 2022

(51) Int. Cl.

*B65D 41/62* (2006.01)
*B65D 41/46* (2006.01)
*B65D 17/00* (2006.01)

(52) U.S. Cl.

CPC ..... *B65D 41/465* (2013.01); *B65D 17/02* (2013.01); *B65D 41/62* (2013.01); *B65D 41/46* (2013.01); *B65D 2251/0015* (2013.01); *B65D 2251/0071* (2013.01); *B65D 2251/20* (2013.01); *B65D 2401/20* (2020.05)

(58) Field of Classification Search

CPC ..... B65D 2401/25; B65D 2401/35; B65D 2401/20; B65D 41/46; B65D 41/48; B65D 2517/0041; B65D 2251/0071; B65D 51/007; B65D 2543/00805; B65D 2517/0098; B65D 55/024; B65D 55/08; B65D 55/0809; B65D 55/0818; B65D 55/0854; B65D 55/0863; B65D 51/20

See application file for complete search history.

(56) References Cited

U.S. PATENT DOCUMENTS

| | | | | | |
|---|---|---|---|---|---|
| D195,314 | S * | 5/1963 | Terwilliger | D9/438 | |
| 3,109,547 | A * | 11/1963 | Wood | B65D 41/485 | 215/256 |
| 3,438,533 | A * | 4/1969 | Wilhelm | B65D 55/06 | 220/257.2 |
| 3,946,891 | A * | 3/1976 | Picoy | B65D 41/58 | 215/256 |
| 4,632,265 | A * | 12/1986 | Cochrane | B65D 41/48 | 215/232 |
| 4,895,270 | A * | 1/1990 | Main | B65D 51/20 | 220/257.2 |
| 5,139,163 | A * | 8/1992 | Diaz | B65D 51/20 | 220/258.2 |
| 7,210,592 | B1 * | 5/2007 | Dautreppe | B65D 41/62 | 206/497 |
| 7,967,163 | B1 * | 6/2011 | Martin | B65D 25/54 | 220/495.06 |
| 8,336,730 | B2 * | 12/2012 | Pontes | B65D 51/20 | 220/716 |
| 9,242,779 | B1 * | 1/2016 | Schildcrout | B65B 61/205 | |
| 2009/0320741 | A1 * | 12/2009 | Pontes | B65D 51/20 | 116/207 |
| 2020/0317395 | A1 * | 10/2020 | Bayona Salazar | B67B 7/40 | |

FOREIGN PATENT DOCUMENTS

| | | | | |
|---|---|---|---|---|
| WO | WO-2008028201 A1 * | 3/2008 | ..... | B65D 51/20 |

* cited by examiner

*Primary Examiner* — Allan D Stevens
(74) *Attorney, Agent, or Firm* — Buche & Associates, P.C.; John K. Buche; Bryce A. Johnson

(57) ABSTRACT

Disclosed is a child-resistant beverage lid with a perforated seal strip, wherein a user can peel away the perforated seal strip and remove the child-resistant beverage lid.

1 Claim, 12 Drawing Sheets

CHILD-RESISTANT LID AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of child-resistant lids for canned beverages and storage units.

Background of the Invention

With the increased sale and use of cannabis related products, there is an increased need for child-resistant packaging, lids, containers, and storage units for such products. As medicinal and recreational use of cannabis and cannabis related products increases, there are more requirements that these cannabis products be stored in child-resistant containers and packaging. For example, the state of California requires that all cannabis flower, pre-rolls, and cannabis products sold within California be in child-resistant packaging. One type of product that is becoming increasingly popular are cannabis infused beverages. Accordingly, the cans for beverages containing cannabis substances should be sealed with a child-resistant lid. One efficient method of providing child-resistant cans is to secure a child-resistant lid onto a common beverage can.

Child resistant lids are also desirable for other types of beverages that may be toxic or harmful if consumed by a child. Accordingly, a need exits for a child-resistant lid that can be secured to the existing beverage can design, so that cannabis related beverages may be child-resistant when stored.

SUMMARY OF THE INVENTION

In view of the foregoing, an object of this specification is to disclose a lid that is child-resistant.

It is another object of this specification to disclose a child-resistant lid with a tamper evident tear away seal strip that may be removed to expose the top of a beverage can.

Other objectives of the disclosure will become apparent to those skilled in the art once the invention has been shown and described.

BRIEF DESCRIPTION OF THE SEVERAL VIEWS OF THE DRAWINGS

The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Figure 1:
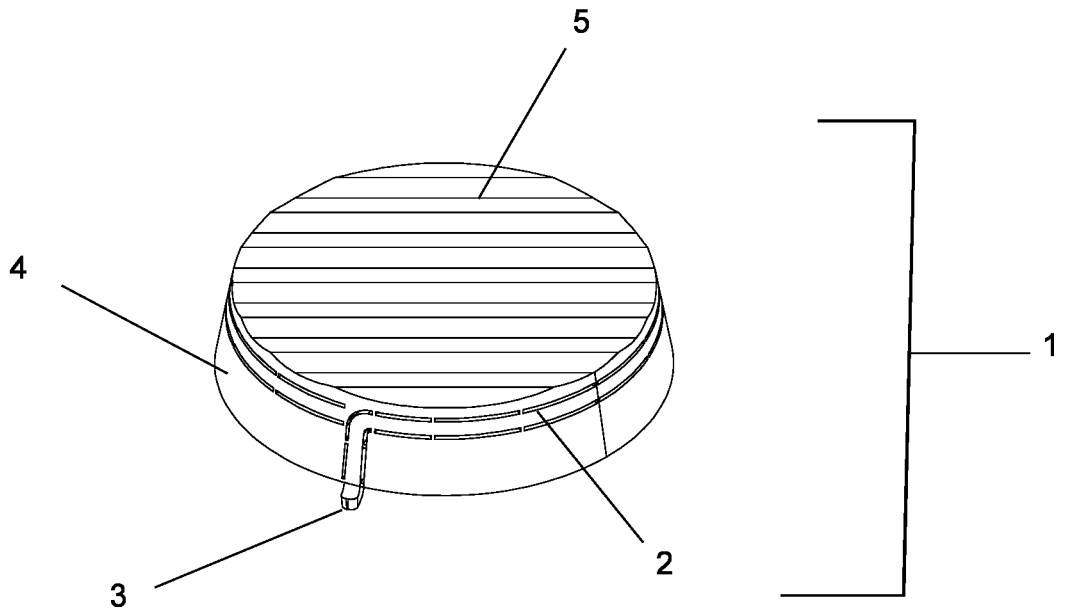
FIG. 1 is a perspective view of one embodiment of the child-resistant lid.

Disclosed are several embodiments of a child-resistant lid. FIG. 1 is a perspective exploded view of one embodiment of the child-resistant lid. Referring to FIG. 1, the child-resistant lid 1 is comprised of a seal strip 2, a tab 3, a base 4, and a cover 5. In a preferred embodiment, the lid 1 is secured to the top of a lip of a can (see FIG. 11). When the lid 1 is secured to a can, the can becomes child-resistant, the pop-tab and mouth opening of the can are concealed, and the contents of the can become more difficult to access. The seal strip 2 is a tamper evident seal that connects the base 4 and the cover 5 via perforations in the lid 1. The seal strip 2 also features a tab 3, which allows a user easy access to grab and tear away the seal strip 2. Suitably, preferred embodiments of the lid 1 may be snap-fit onto the rim of a typical pop-top aluminum can that is known to hold beverages like beer or soda. In preferred embodiments of the lid 1, a tear away strip may be removed to allow the cover 5 of the lid to be removed to expose the pull-tab of the aluminum can, whereby a user may open the can to consume any contained beverage. A more detailed description of the preferred embodiments is provided below with reference to the figures.

Figure 2:
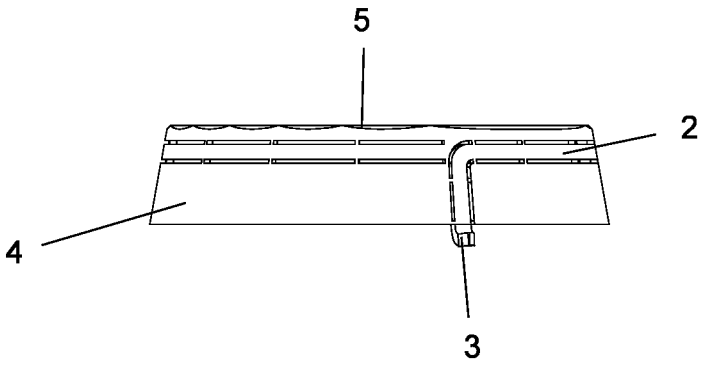
FIG. 2 is a front view of one embodiment of the child-resistant lid.
Figure 3:
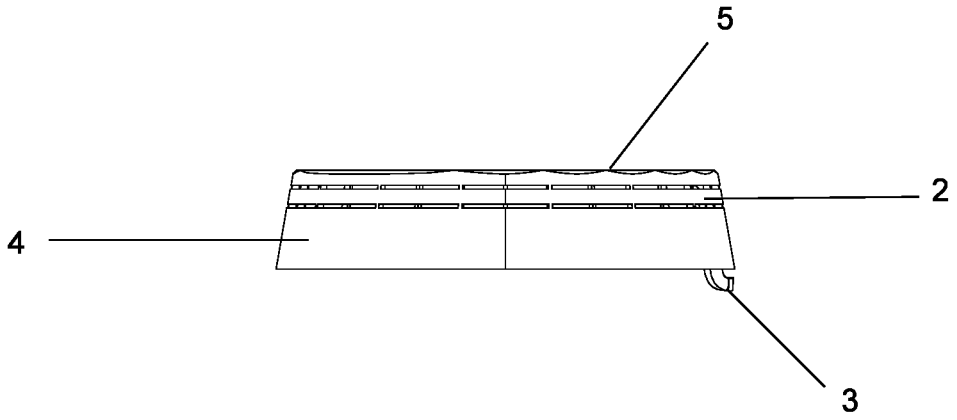
FIG. 3 is a side view of one embodiment of the child-resistant lid.
Figure 4:
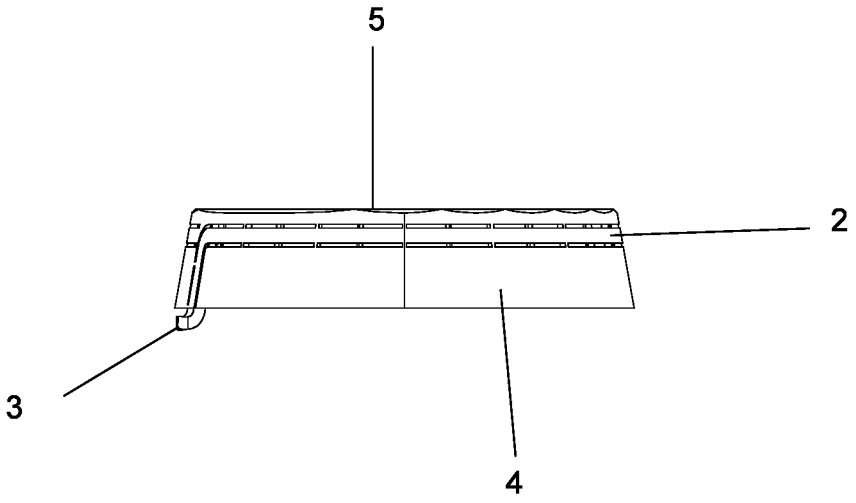
FIG. 4 is a side view of one embodiment of the child-resistant lid.
Figure 5:
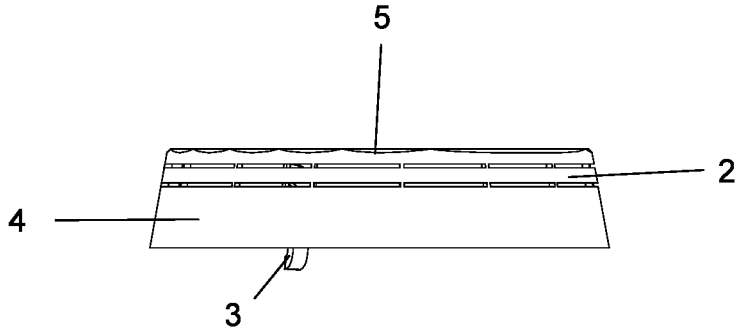
FIG. 5 is a back view of one embodiment of the child-resistant lid.

FIG. 2 is a front view of one embodiment of the child-resistant lid. FIG. 3 is a side view of one embodiment of the child-resistant lid. FIG. 4 is a side view of one embodiment of the child-resistant lid. FIG. 5 is a back view of one embodiment of the child-resistant lid. Referring to FIGS. 2-5, in one embodiment, the tab 3 of the seal strip 2 may begin at the bottom of the base 4 of the lid 1 and then the seal strip 2 runs up the base 4 and then turns horizontal and runs along the entire perimeter of the side of the lid. Accordingly, when the tab 3 of the seal strip 2 is pulled, it can be pulled along, tearing the seal strip 2, the entire way around the lid 1, whereby the cover 5 is completely separated from the base 4. In another embodiment, the tab 3 may start in line with the seal strip 2, wherein the seal strip 2 and tab 3 form a horizontal strip between the base 4 and cover 5. See FIGS. 12A-D. Once the cover 5 is separated from the base 4, the cover 5 may be removed, whereby a user can access the top of the can and open it. In another embodiment, the base 4 may also be removed from the can by pulling or pushing the base 4 up and releasing the snap-fit. In a preferred embodiment, the child-resistant lid 1 may be comprised of plastic. In an alternative embodiment, the lid 1 may be comprised of aluminum, or other rigid material known to one of skill in the art.

Figure 6:
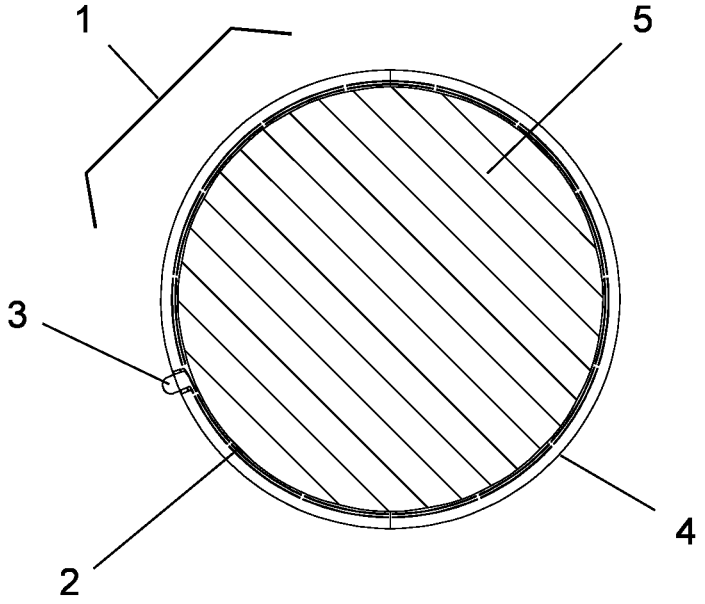
FIG. 6 is a top view of one embodiment of the child-resistant lid.
Figure 7:
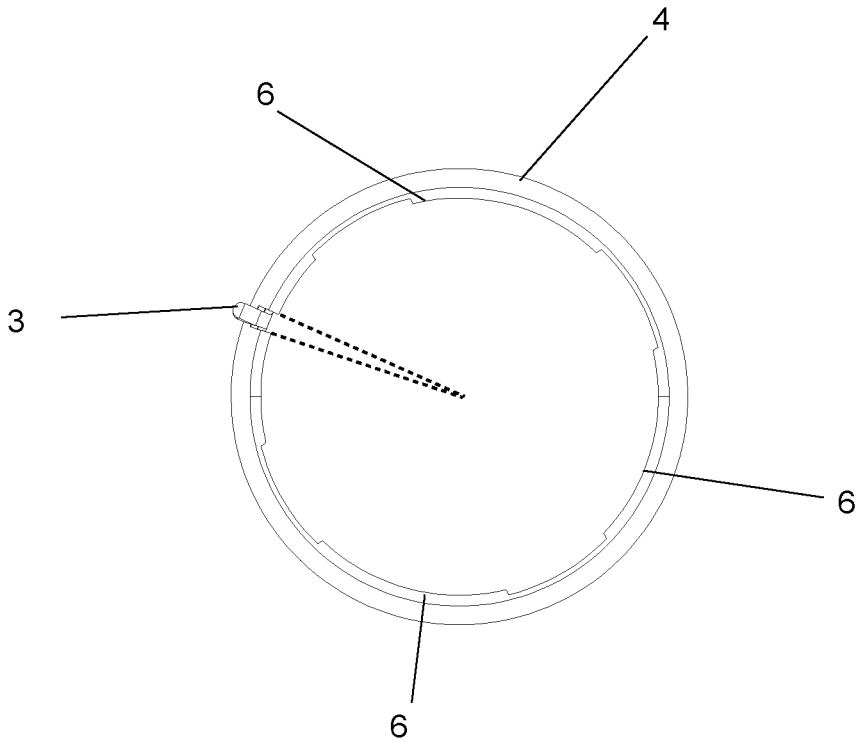
FIG. 7 is a bottom view of one embodiment of the child-resistant lid.

FIG. 6 is a top view of one embodiment of the child-resistant lid. FIG. 7 is a bottom view of one embodiment of the child-resistant lid. Referring to FIG. 7, the inside of the base 4 may feature a snap fit mechanism that is defined by an annular crevice with a protruding ledge 6, or protruding ledges 6, that form a snap-fit over the lip edge of the top rim of the can whenever the lip of the can is inserted into the annular crevice. See also FIGS. 9 & 10. This allows the lid to be snapped in place and secured over the top rim of a can to form a child-resistant seal once the rim is inserted into the annular crevice.

Figure 8:
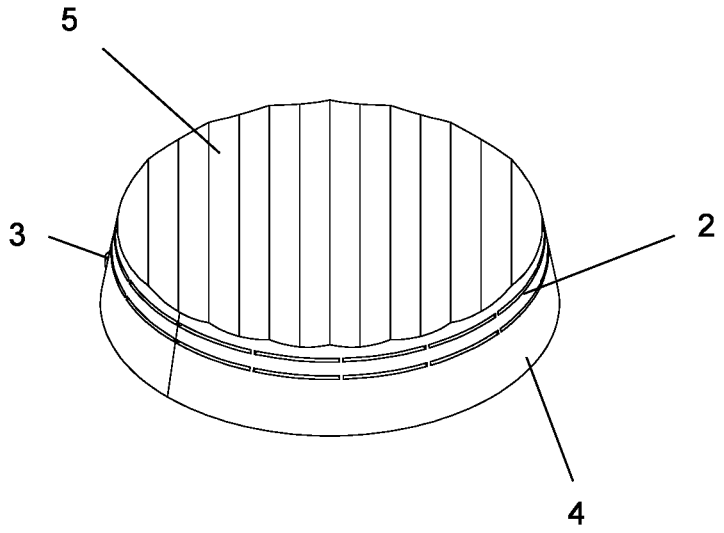
FIG. 8 is a perspective view of one embodiment of the child-resistant lid.
Figure 9:
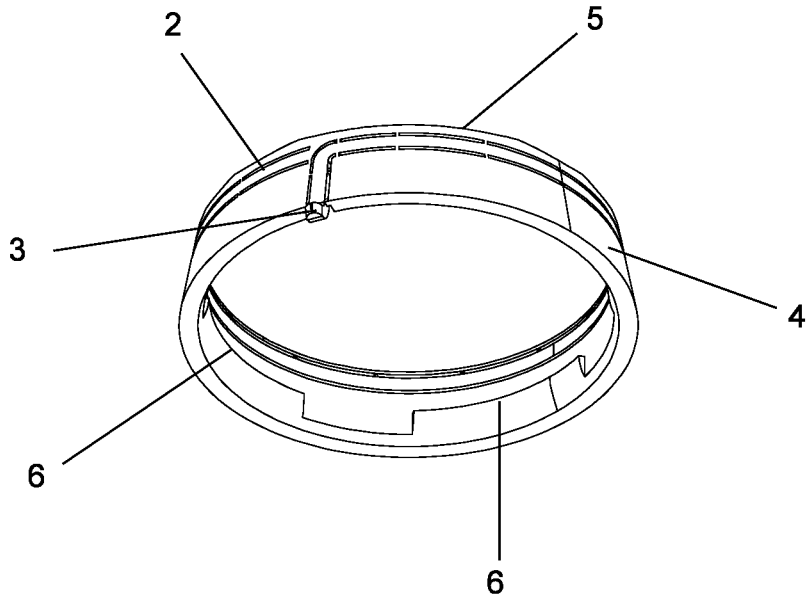
FIG. 9 is a bottom perspective view of one embodiment of the child-resistant lid.
Figure 10:
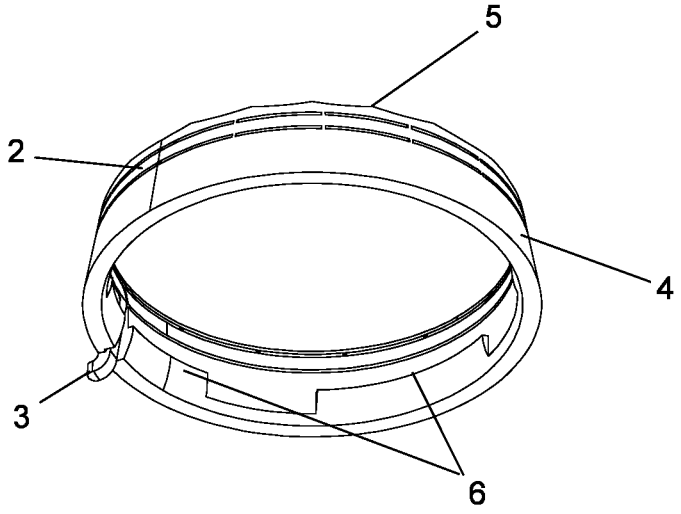
FIG. 10 is a bottom perspective view of one embodiment of the child-resistant lid.
Figure 11:
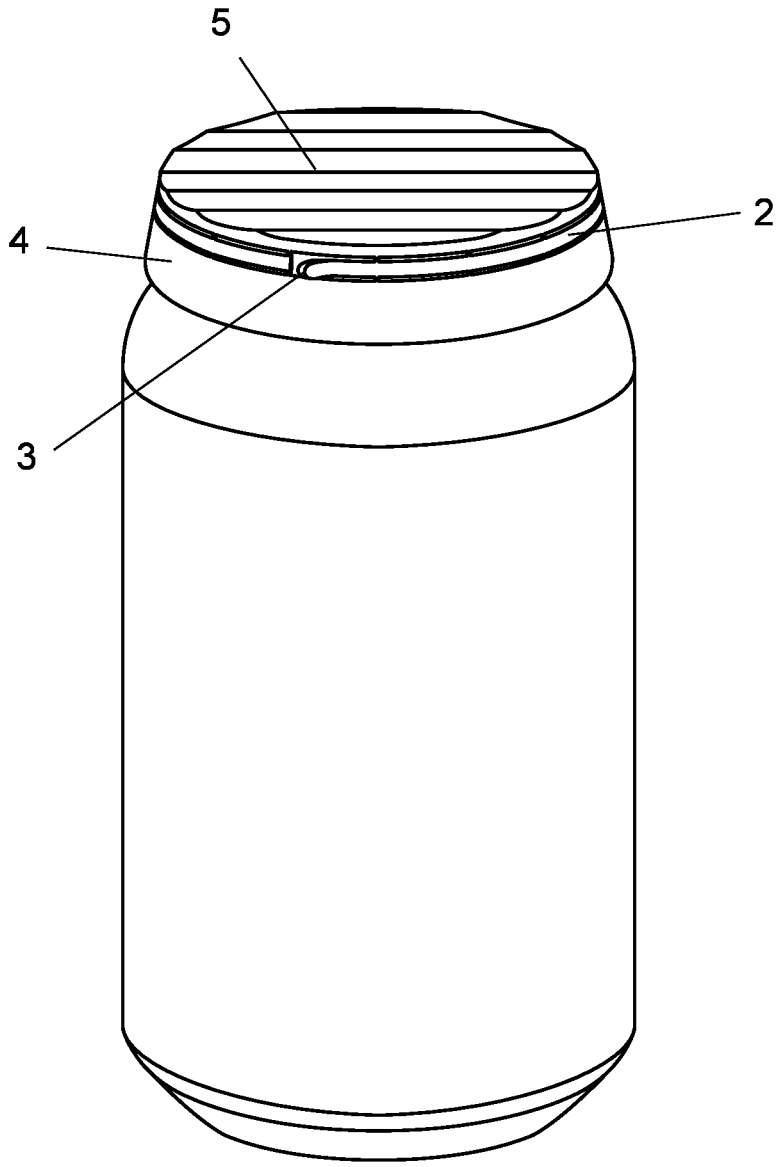
FIG. 11 is an environmental view of one embodiment of the child-resistant lid.
Figure 12A:
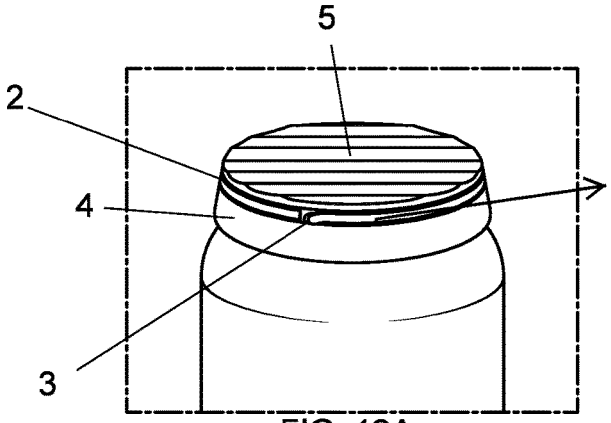
FIG. 12A is an illustration of a step of a preferred method of using the child-resistant lid.
Figure 12B:
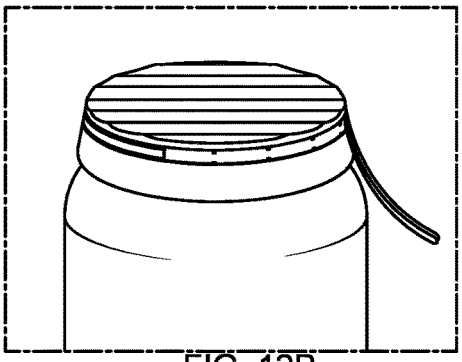
FIG. 12B is an illustration of another step of a preferred method of using the child-resistant lid.
Figure 12C:
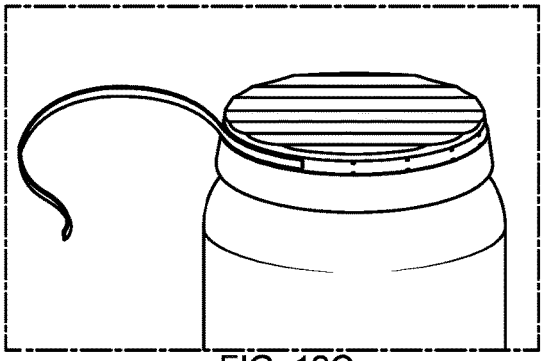
FIG. 12C is an illustration of yet another step of a preferred method of using the child-resistant lid; and, FIG. 12D is an illustration of a final step of a preferred method of using the child-resistant lid.
Figure 12D:
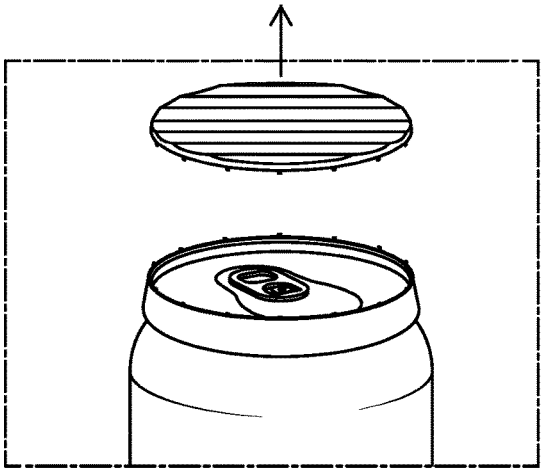

FIG. 8 is a perspective view of one embodiment of the child-resistant lid. FIG. 9 is a bottom perspective view of one embodiment of the child-resistant lid. FIG. 10 is a bottom perspective view of one embodiment of the child-resistant lid. FIG. 11 is an environmental view of one embodiment of the child-resistant lid. As shown in FIGS. 7 and 9, a perforated seal strip (2) is disposed (in part) within a sector bound by two radii (broken lines) and an arc of a circle defined by the external plan of the annular base (4).

FIG. 12A-D are a flow diagram of an environmental view of the child-resistant lid. In use, a user may make a can child resistant by snapping the base of the lid 1 over the edges of the top of a can. Once the lid is secured on top of the can, to expose the top of the can to be open to be consumed, a user may: (i) grip the tab 3; (ii) pull the tab 3 along the path of the seal strip 2; (iii) remove the seal strip 2 by pulling the tab 3 along the entire length of the seal strip 2 around the perimeter of the lid 2, whereby the seal strip 2 is completely removed and apart from the lid 1; and, (iv) remove the cover 5, whereby a use can open the top of the can to access the contents of the can.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A method of removing a child-resistant lid (1) from a can comprising the steps of:

Step 1: obtaining the lid (1) comprising an annular base (4), wherein the annular base (4) features an upper circumferential edge, a lower circumferential edge, four protruding ledges (6) that each define an inwardly tapered surface on an inside of the annular base (4) between said upper and lower circumferential edges, wherein each inwardly tapered surface begins at a lowermost surface of the annular base, and a sector through one of the protruding ledges from the upper circumferential edge to the lower circumferential edge, a cover (5) defined by a circular disk with a lower circumferential edge, a perforated seal strip (2) disposed in said sector and between the upper circumferential edge of the annular base (4) and the lower circumferential edge of the cover (5) so that the cover (5) is removably attached to the annular base (4) via the seal strip (2) and, a tab (3) on an end of the perforated seal strip (2) that is exposed, whereby a user can grip the tab (3);

Step 2: placing the lower circumferential edge of the annular base (4) around an upper lip of the can;

Step 3: forcing the upper lip of the can toward the upper circumferential edge of the annular base (4) so that the upper lip of the can slides along each inwardly tapered surface until the annular base is over the top of the upper lip of the can and each of the four protruding ledges (6) snap to have an interface with the upper lip of the can to form a child resistant seal of the can;

Step 4: gripping the tab (3);

Step 5: pulling the tab (3) until the perforated seal strip is pulled out of the sector and out from between the upper circumferential edge of the annular base (4) and the lower circumferential edge of the cover (5), wherein pulling the tab results in perforations on two sides of the seal strip (2) being torn such that the seal strip (2) is torn away from the annular base (4) and cover (5); and, Step 6: removing the cover (5) from the lid (1) such that the annular base (4) remains over the top of the upper lip of the can, and the top of the can is exposed and may be opened.

* * * * *